US009710980B1

(12) United States Patent
Alzahrani

(10) Patent No.: US 9,710,980 B1
(45) Date of Patent: Jul. 18, 2017

(54) BIOMETRIC ATTENDANCE TRACKING SYSTEM AND METHOD USING MOBILE DEVICES

(71) Applicant: Nasser Alzahrani, Chicago, IL (US)

(72) Inventor: Nasser Alzahrani, Chicago, IL (US)

( * ) Notice: Subject to any disclaimer, the term of this patent is extended or adjusted under 35 U.S.C. 154(b) by 0 days.

(21) Appl. No.: 15/160,677

(22) Filed: May 20, 2016

(51) Int. Cl.
*G07C 9/00* (2006.01)
*G07C 1/10* (2006.01)

(52) U.S. Cl.
CPC ..... *G07C 9/00158* (2013.01); *G07C 1/10* (2013.01)

(58) Field of Classification Search
CPC ..... G07C 9/00158; G07C 1/10
See application file for complete search history.

(56) References Cited

U.S. PATENT DOCUMENTS

| | | | | |
|---|---|---|---|---|
| 2004/0066276 | A1 | 4/2004 | Gile et al. | |
| 2006/0035205 | A1* | 2/2006 | Dobson | G07C 9/00111 434/350 |
| 2009/0148827 | A1* | 6/2009 | Argott | G09B 7/02 434/433 |
| 2009/0254464 | A1 | 10/2009 | Bonner et al. | |
| 2012/0161971 | A1 | 6/2012 | Nasir et al. | |
| 2013/0237240 | A1* | 9/2013 | Krantz | H04W 4/02 455/456.1 |
| 2014/0324649 | A1* | 10/2014 | Marshall | G06Q 10/1091 705/32 |

FOREIGN PATENT DOCUMENTS

CN 203149675 U 8/2013

OTHER PUBLICATIONS

I. Ken Nam, et al., "Fingerprint Recognition Student Attendance Management System", http://eprints.utar.edu.my/1829/1/IA-2015-1304584-1.pdf. May 2015, pp. 189.
Karthik Vignesh E, et al., "A foolproof biometric attendance management system", International Journal of Information and Computation Technology, vol. 3, No. 5, 2013, pp. 433-438.

* cited by examiner

*Primary Examiner* — Leon Flores
(74) *Attorney, Agent, or Firm* — Oblon, McClelland, Maier & Neustadt, L.L.P.

(57) ABSTRACT

Aspects of the disclosure provide a host mobile device for tracking attendance of a plurality of attendees each operating an attendee mobile device. The host mobile device includes a processor configured to execute program instructions, and a memory configured to store program instructions for causing the processor to receive an access request including attendee identification information of an attendee from an attendee mobile device, determine whether a first set of access conditions are satisfied in response to the access request, and allow the attendee mobile device to submit biometric information of an attendee to the host mobile device when the set of access conditions are satisfied. The first set of access conditions includes whether an operation distance between the host mobile device and the attendee mobile device is shorter than a preconfigured threshold distance defining a border of an area for a session attendees have registered for.

20 Claims, 5 Drawing Sheets

BIOMETRIC ATTENDANCE TRACKING SYSTEM AND METHOD USING MOBILE DEVICES

GRANT OF NON-EXCLUSIVE RIGHT

This application was prepared with financial support from the Saudi Arabian Cultural Mission, and in consideration therefore the present inventor(s) has granted The Kingdom of Saudi Arabia a non-exclusive right to practice the present invention.

BACKGROUND

The background description provided herein is for the purpose of generally presenting the context of the disclosure. Work of the presently named inventors, to the extent the work is described in this background section, as well as aspects of the description that may not otherwise qualify as prior art at the time of filing, are neither expressly nor impliedly admitted as prior art against the present disclosure.

The traditional approach for taking attendance in a classroom or a meeting room depends on self-reporting of attendance and paper records, which lacks accuracy and can be cumbersome and time consuming. Modern gatherings of students and professionals nearly always include those attendees' mobile devices, such as laptops, tablets, and mobile phones. It would be more efficient if these mobile devices can be leveraged to track attendance.

SUMMARY

Aspects of the disclosure provide a host mobile device for tracking attendance of a plurality of attendees each operating an attendee mobile device. The host mobile device includes a processor configured to execute program instructions, and a memory configured to store program instructions for causing the processor to receive an access request including attendee identification (ID) information of an attendee from an attendee mobile device, determine whether a first set of access conditions are satisfied in response to the access request from the attendee mobile device, and allow the attendee mobile device to submit biometric information of an attendee to the host mobile device when the set of access conditions are satisfied. The first set of access conditions includes whether current time is within an available time window that is currently open for attendees to report attendance, the available time window being associated with a session that attendees have registered for, whether an operation distance between the host mobile device and the attendee mobile device is shorter than a preconfigured threshold distance associated with the session having the available time window, the preconfigured threshold distance defining a border of an area for the session having the available time window, and whether the attendee identification (ID) information included in the access request is included in an attendee list associated with the session having the available time window.

In one example, the memory is further configured to store program instructions for causing the processor to receive biometric information from the attendee mobile device, perform biometric identification on the received biometric information to identify an attendee corresponding to the received biometric information, and make an attendance record of the identified attendee corresponding to the session having the available time window.

In one example, the host mobile device further includes communication circuitry configured to establish a wireless communication channel between the host mobile device and the attendee mobile device, and estimate the operation distance between the host mobile device and the attendee mobile device based on the strength of a wireless signal transmitted from the attendee mobile device. In one example, the communication circuitry implements Bluetooth low energy (BLE) technology.

Aspects of the disclosure provides an attendee mobile device for reporting attendance of an attendee to a host mobile device. The attendee mobile device includes a processor configured to execute program instructions, and a memory configured to store program instructions for causing the processor to determine whether a second set of access conditions are satisfied, transmit an access request including attendee ID information of an attendee to the currently connected host mobile device when the set of access conditions are satisfied, and transmit biometric information of an attendee to the currently connected host mobile device when the access request is allowed by the currently connected host mobile device. The second set of access conditions includes whether current time is within an available time window that is currently open for attendees to report attendance, the available time window being associated with a session that attendees have registered for, whether a host mobile device associated with the session having the available time window is currently connected to the attendee mobile device, and whether an operation distance between the currently connected host mobile device and the attendee mobile device is shorter than a preconfigured threshold distance defining a border of an area for the session having the available time window.

Aspects of the disclosure provide a method for tracking attendance of a plurality of attendees operating a plurality of attendee mobile devices at a host mobile device. The method includes receiving an access request including attendee identification (ID) information of an attendee from an attendee mobile device, determining whether a set of access conditions are satisfied in response to the access request from the attendee mobile device, and allowing the attendee mobile device to submit biometric information of an attendee to the host mobile device when the set of access conditions are satisfied.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

Various embodiments of this disclosure that are proposed as examples will be described in detail with reference to the following figures, wherein like numerals reference like elements, and wherein.

DETAILED DESCRIPTION OF EMBODIMENTS

Figure 1:
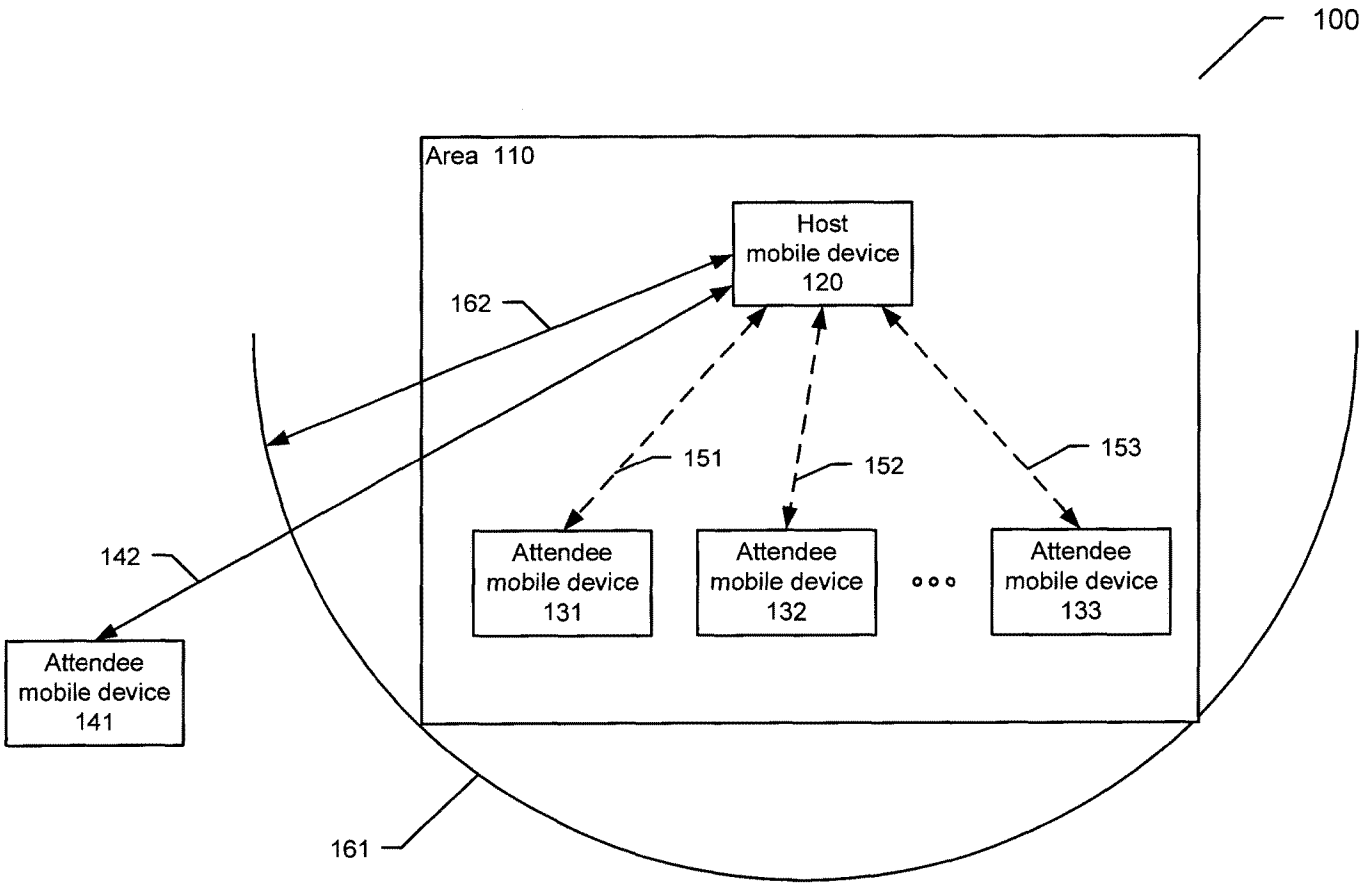
FIG. 1 shows an exemplary attendance tracking system according to an embodiment of the disclosure.

FIG. 1 shows an exemplary attendance tracking system 100 according to an embodiment of the disclosure. The attendance tracking system 100 includes a host mobile device 120 and a plurality of attendee mobile devices 131-133. The host mobile device 120 is configured to take attendance of a plurality of attendees who attends a session in an area 110. A session refers to a gathering of people which lasts for a period of time, such as a class at a school, a meeting at a business organization, and the like. An area refers to an amount of space at a location where a session takes place, such as an area of a classroom, a meeting room, a school bus or any sites where people meet.

Each of the host mobile device 120 and the attendee mobile devices 131-133 can be a mobile phone, a tablet computer, a laptop computer, a wearable device, and the like. Each attendee mobile device 131-133 and the host mobile device 120 can establish a wireless communication channel 151-153 for communications between each attendee mobile device 131-133 and the host mobile device 120, for example using Bluetooth technology. Accordingly, an attendee registered for the session in the area 110 can operate one of the attendee mobile devices 131-133 to report his attendance to the host mobile device 120. A host, such as a teacher in a class, can configure the host mobile device 120 to receive attendance information transmitted from the attendee mobile devices 131-133. It is noted that an attendee can use his own mobile device or borrow a mobile device from another attendee to perform an attendance report.

According to an aspect of the disclosure, the attendance tracking system 100 can be configured in such a way that, during a session, the host mobile device 120 only accepts an attendance report from attendee mobile devices 131-133 that have an operational distance shorter than a threshold distance associated with the session. A distance between locations of the host mobile device 120 and each attendee mobile device 131-133 is referred to as an operation distance of the respective attendee mobile device 131-133. A host mobile device 120 can estimate an operation distance of an attendee mobile device 131-133 by measuring strength of a wireless signal received from the respective attendee mobile device 131-133. Similarly, each attendee mobile device 131-133 can estimate an operation distance of itself by measuring strength of a wireless signal received from the host mobile device 120.

A threshold distance of a session defines a border of an area where the session takes place for determining an attendee's presence at the session. For example, in FIG. 1, a circle 161 with a radius of a threshold distance 162 and a center of location of the host mobile device 120 is defined as an border 161 of the area 110. Accordingly, an attendee inside the defined border is considered to be in attendance at the session and is eligible for an attendance record, while an attendee outside the defined border is counted to be absent from the session. In FIG. 1 example, attendance reports from the attendee mobile devices 131-133 are accepted, while for an attendee 141 having an operation distance 142 longer than the threshold distance 162 thus being outside of the border 161, attempt of reporting an attendance will be refused by the host mobile device 120. In addition, a host of a session who takes attendance for the session can configure a threshold distance for the session and stores the preconfigured threshold distance in the host mobile device 120.

The above scheme of using a threshold distance for determining attendee presence at a session is based on measurement of signal strength of wireless signals transmitted between a host mobile device 120 and an attendee mobile device 131-133. This scheme eliminates dependence on certain positioning systems (e.g. satellite-based positioning systems) for determining a location of an attendee which are not always available when in a building.

According to another aspect of the disclosure, the attendance tracking system 100 can additionally employ biometric methods to verify or identify identities of attendees. For example, each attendee mobile device 131-133 can include one or multiple suitable biometric sensors for taking different types of biometric inputs, such as face image, voice samples, fingerprint, iris image, and the like, of an attendee attending a session, and generating biometric information of the attendee. The biometric information is subsequently transmitted to the host mobile device 120 that performs a biometric identification based on the received biometric information. Utilization of biometric methods reduces possibilities of intentional (e.g. buddy punching), or unintentional misidentification to an attendance tracking system, and improves accuracy of attendance tracking.

Scenarios of taking attendance at educational institutions, such as a university or a school, are used as examples below for description of attendance tracking systems or methods of the disclosure. For example, when taking attendance in a classroom at a school, a teacher plays a role of a host using his/her mobile phone as a host mobile device 120. Space of the classroom is an area, while a class conducted in the classroom is a session. Students taking a course corresponding to the class are attendees who each operate a mobile phone (his own phone or a classmate's phone) as an attendee mobile device 131-133 to report his presence. Students' attendances at the class are recorded by the teacher's mobile phone. It is noted that the scope of the disclosure is not limited to scenarios at educational institutions. The systems and methods described below can be applied to any suitable scenarios where attendance tracking is performed, such as government agencies, hospitals, armies, business organizations, tourism industry, and the like.

Figure 2:
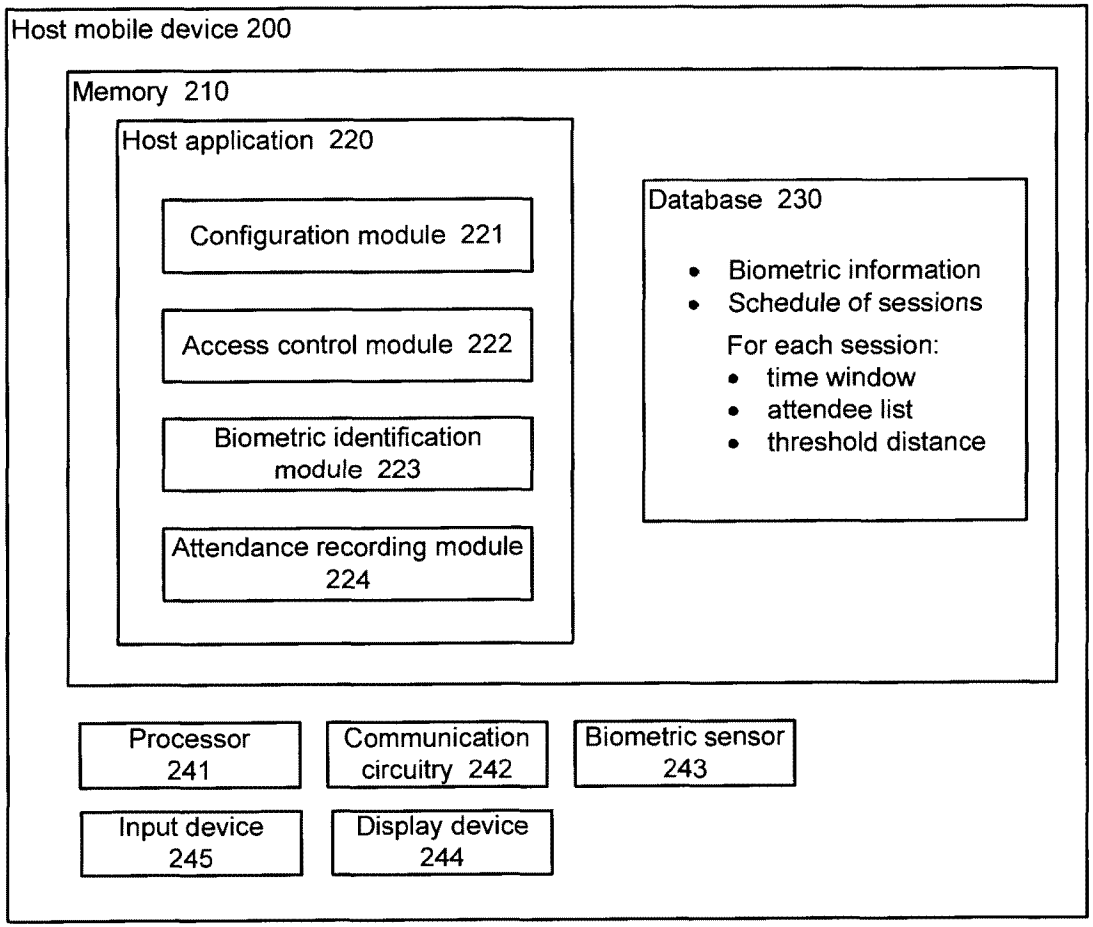
FIG. 2 shows an exemplary host mobile device according to an embodiment of the disclosure.

FIG. 2 shows an exemplary host mobile device 200 according to an embodiment of the disclosure. In one example, the host mobile device 200 is operated by a teacher, and configured to take attendance of students attending a class at a classroom in a school. The host mobile device 200 can be any suitable mobile device, such as a laptop computer, a mobile phone, a tablet computer, a personal digital assistant (PDA), a smart watch, and the like. The host mobile device 200 includes hardware components, such as a memory 210, a processor 241, communication circuitry 242, a biometric sensor 243, a display device 244, an input device 245, and software components, such as various program instructions and data stored in the memory 210. The processor 241 operates according to the software components to perform various tasks.

In one example, the memory 210 stores a host application 220. The host application 220 includes instructions which, when executed by the processor 241, causes the processor 241 to perform various attendance tracking functions. In one example, the host application 220 can be downloaded from a website on the Internet, and installed on the host mobile device 200. In addition, in the one example, the memory 210 stores a database 230 containing data used or generated by the host application 220.

The database 230 can include biometric information of students (attendees). The biometric information of a student includes biometric features of the student. In various examples, different type of biometric features can be used. For example, a biometric input of a student, such as a fingerprint image, a face image, a sample of voice, an iris image, and the like, can be captured using a biometric sensor. Thereafter, the biometric input can be processed and biometric information can be extracted from the biometric input.

In an example, the biometric information of each student is collected through an enrollment process. The students have registered for one or more courses lectured by the teacher operating the host mobile device 200. During the enrollment process, one or more types of biometric information of a student can be collected. In one example, the collection is performed using the host mobile device 200. In another example, the collection is performed using other systems or devices, then collected biometric information is received to the host mobile device 200, for example, by downloading from a computer on the Internet.

In one example, the database 230 also includes a schedule of classes (sessions). The classes can belong to one or multiple courses lectured by the teacher operating the host mobile device 200. Each class is associated with a time window for students registered for the class to report attendance. The teacher can configure a starting time and an ending time of the time window. A starting time or an ending time can include a date and a time (hour, minute). In one example, the time window includes a starting time and an ending time, and students registered for the class are allowed to report attendance only within the time window.

In addition, each class is associated with an attendee list. The attendee list can include student identification (ID) information of students registered for the class, such as student names, student ID numbers, and the like. In an example, students not registered for a class are not accepted for their attendance report for the class. Further, each class is associated with a threshold distance. As explained above, when an operation distance of a attendee mobile device to a host mobile device is longer than the threshold distance configured for a class, the attendee mobile device is not allowed to submit biometric information to the host mobile device. Additionally, the database can include other related information, such as titles, locations, time periods of courses.

In one example, the host application 220 includes modules executed by the processor 241 for performing attendance tracking functions, such as a configuration module 221, an access control module 222, a biometric identification module 223, and an attendance recording module 224.

The configuration module 221 is configured to perform multiple configuration functions. In one example, the configuration module 221 can perform a biometric enrollment process to collect biometric information stored in the database 230. Specifically, the configuration module 221 can display prompt information from a user interface on the display device 244 requiring a student to input his ID information, and provide biometric input through the biometric sensor 243. Thereafter, the configuration module 221 can store biometric information and associated student ID information of the student as an entry in the database 230.

In another example, the configuration module 221 can perform a session configuration process during which a teacher can operate the host mobile device 220 to create a schedule of sessions, and associated session information with each session. The session information can include a time window, an attendee list, and a threshold distance.

Alternatively, in other examples, the configuration module 221 can perform processes that import biometric information or a schedule of sessions each associated with respective session information from outside of the host mobile device, such as another computer, through a network or a portable storage device.

In a further example, the configuration module 221 can perform a session modification process during which a teacher can operate the host mobile device 200 to modify the schedule of sessions and associated session information stored in the database 230. In one example, once a time window or a threshold distance of a session is performed, a modification indicator is attached to each item of student ID information (e.g., student name, or student ID number) in the attendee list that is associated with the modified session. This modification indicator can be used to process an updating request from an attendee mobile device 131-133.

The access control module 222 is configured to receive an access request from an attendee mobile device 131-133, and in response to the reception of the access request, determine whether to authorize an attendee mobile device 131-133 to provide biometric information to the host mobile device 200 based on some access conditions. In one example, an access request for reporting attendance to a class is received at the access control module 222 through the communication circuitry 242. As a response, the access control module 222 examines if some combination of one or more of the following access conditions are satisfied: (1) whether the time when receiving the access request is within a time window of a class currently open for reporting attendance, (2) whether an operation distance of the requesting attendee mobile device is shorter than a preconfigured threshold distance corresponding to the time window currently open for reporting attendance, and (3) whether student ID information in the access request belongs to an attendee list corresponding to the time window currently open for reporting attendance.

Specifically, in an example, when receiving the access request, the access control module 222 consults a schedule of sessions stored in the database 230 to determine if a time window associated with a session (a class) is currently available for reporting attendance (the first access condition). The availability of a time window refers to whether the current time is within a time period between the starting time and open time of the time window. When no time window is available, the access control module 222 denies the access request. When a time window is currently available, the access control module 222 can authorize the request or if additional requirements are present the access control module 222 can next examine the other access conditions.

For the second access condition, the access control module 222 retrieves from the data base 230 a preconfigured threshold distance associated with the session having the time window currently open. In addition, the access control module 222 receives from the communication circuitry 242 an estimated operation distance between the requesting attendee mobile device 131-133 and the host mobile device 200. Then, the access control module 222 determines whether the operation distance of the requesting attendee mobile device is shorter than the preconfigured threshold distance. When the operation distance of the requesting attendee mobile device is longer than the preconfigured threshold distance, the access request is denied. Otherwise, the access control module 222 can authorize the access request or if additional conditions are required the access control module 222 can further examine the third access condition.

For the third access condition, the access control module 222 retrieves from the data base 230 an attendee list associated with the session having the time window currently open. Subsequently, the access control module 222 checks whether the student ID information in the access request is included in the retrieved attendee list. When the student ID information in the access request is included in the retrieved attendee list, the access control module 222 will authorize the access request.

After the above examination on the access conditions, the access control module 222 sends a message through the communication circuitry 242 to inform the requesting attendee mobile device of the result.

The above described access control scheme can be employed to control the time period and location for a student to report attendance to a class. It is noted that which access conditions to be examined and in what order can be changed and configured by a host (a teacher) for various application scenarios.

In one example, the access control module 222 is further configured to receive an initialization request including student ID information of a student from an attendee mobile device 131-133, and in response to the initialization request, transmit session information of sessions which the student has registered for to the requesting attendee mobile device 131-133. The session information transmitted can include time windows and threshold distances associated with each session in the schedule. The attendee mobile device 131-133 can receive and store the transmitted session information for its future operation.

In another example, the access control module 222 is further configured to receive an updating request including student ID information of a student from an attendee mobile device 131-133, and in response to the updating request, transmit modified session information of sessions which the student has registered for to the requesting attendee mobile device 131-133. For example, the access control module 222 can check whether a modification indicator is associated with the student ID information in some attendee lists, and subsequently transmit modified session information of sessions that have been modified. The modified session information can include time windows and preconfigure threshold distances associated with each modified session in a schedule. The requesting attendee mobile device 131-133 can accordingly update a locally stored schedule of sessions and associated session information of each session.

The biometric identification module 223 is configured to receive a message including biometric information from an attendee mobile device 131-133, and perform biometric verification or identification on the received biometric information. In an example, after an access request is authorized, an attendee mobile device 131-133 sends a message including biometric information of a student. It is noted that multiple attendees can share a same attendee mobile device 131-133 to report an attendance. After receiving the message, the biometric identification module 223 can subsequently perform a biometric verification or identification.

In one example, a biometric verification process is performed. In this case, the message containing the biometric information also includes student ID information. Accordingly, in the biometric verification process, the biometric identification module 223 retrieves biometric information of a certain student from the database 230 based on the received student ID information, and compares the retrieved biometric information with the received biometric information. If the retrieved biometric information matches the received biometric information, identity of the student attendee is verified. Thereafter, the biometric identification module 223 determines whether the verified student ID information is included in an attendee list associated with a class (session) having a currently opened time window for reporting attendance. When the verified student ID information is included in an attendee list, it can be determined that the attendance report is validated.

In another example, a biometric identification process is performed. In this case, only providing biometric information in the message is sufficient for the biometric identification process. Accordingly, the biometric identification module 223 retrieves multiple items of biometric information from the database 230. The multiple items of biometric information correspond to an attendee list associated with a class (session) having a currently opened time window for reporting attendance. Then, the biometric identification module 223 compares the received biometric information with the retrieved multiple items of biometric information one by one to search for a matched one of the retrieved multiple items. When a matched item of biometric information is found, student ID information associated with the matched item can be subsequently determined. Consequently, the attendance report is validated. It is noted that in contrast to the biometric verification process, the biometric identification process does not require an attendee to provide student ID information when reporting attendance, thus user interface of an attendee mobile device and respective reporting process can be simplified.

At the end of the biometric verification or identification process, the biometric identification module 223 sends a message through the communication circuitry 242 to inform the requesting attendee mobile device 131-133 of the result.

The attendance recording module 224 is configured to make an attendance record for a verified or identified attendee. For example, triggered by a result of the verification or identification process, the attendance recording module 224 can generate an attendance record and store the attendance record in the database 230. In an example, the attendance record includes student ID information, associated session information, date and time when the record is made, and the like. Based on attendance records thus generated, an attendance report for a class (session), or a course during a certain period can be produced and analyzed.

The memory 210 can include one or more storage media that provide memory spaces for various storage needs. The storage media can include, but are not limited to, hard disk drive, optical disc, solid state drive, read-only memory (ROM), dynamic random access memory (DRAM), static random access memory (SRAM), flash memory, and the like. In addition, the memory 210 can include memory spaces (not shown) allocated for storing other software components, such as operation systems, other application software, and data related with the other software component.

The processor 241 can include one or more processing units to execute various program instructions to perform various tasks. In an example, the processor 241 is a multi-core processor, such as a dual-core processor, a quad-core processor, and the like. In addition, the processor 241 can have any suitable architecture, such as an x86 architecture, a reduced instruction set computing (RISC) architecture, a complex instruction set computing (CISC) architecture, and the like. In an example, the electronic device 241 is a mobile device having an advanced RISC machine (ARM) type processor.

The communication circuitry 242 is configured to establish a wireless communication channel between the host mobile device 200 and other attendee mobile device 131-133. In one example, the communication circuitry 242 includes a circuit implementing Bluetooth low energy (BLE) technology. BLE is a wireless personal area network technology designed by the Bluetooth Special Interest Group, and specified in the Bluetooth 4.0 specifications.

In the example, connections can be established between the host mobile device 200 and other attendee mobile devices 131-133 which also implementing BLE. For example, during a configuration process, the host mobile device 200 and each attendee mobile device 131-133 can go through a manually-operated bonding process. During the bonding process, identity information of the host or attendee mobile devices is exchanged to set up trust and encryption keys are shared for future data exchange. The identity information can include an identifier representing a host or attendee mobile device. After the bonding relationships are formed, the connection between the host mobile device 200 and each attendee mobile device 131-131 can be established automatically when the host mobile device 200 and each attendee mobile device 131-131 are in vicinity of each other. Accordingly, the communication circuitry 242 can create and maintain a list of mobile devices (represented using identifiers) which are currently connected to the host mobile device 200.

It is noted that at the moment when a connection is established, an operation distance of the attendee mobile device 131-133 may be longer than a threshold distance of the host mobile device 200. Accordingly, an attendee needs to enter an area having a border defined by the threshold distance to have their attendance report accepted by the host mobile device 200.

The communication circuitry 242 is further configure to estimate an operation distance between the host mobile device 200 and an attendee mobile device 131-133 based on strength of a wireless signal transmitted from the respective attendee mobile device 131-133. In one example, the communication circuitry 242 includes a circuit implementing BLE technology. The circuit can calculate a Received Signal Strength Indicator (RSSI) based on a message received from an attendee mobile device, and subsequently estimate a distance between the host mobile device 200 and the attendee mobile device using the RSSI.

The biometric sensor 243 is configured to receive a biometric input and generate biometric information corresponding to the biometric input. In one example, the biometric sensor 243 includes a fingerprint scanner configured to capture a fingerprint image and subsequently generate a fingerprint template. The generate fingerprint template includes fingerprint features extracted from the fingerprint image. In an example, the biometric sensor 243 is used during a biometric enrollment process. During the biometric enrollment process, biometric information of attendees registered for classes lectured by a teacher using the host mobile device 200 is collected and stored in the memory 230. In another example, the biometric sensor 243 is an external portable device (e.g., a fingerprint scanner with a USB connector), and not included in the host mobile device 200.

The display device 244 is configured to display a user interface of the host application 220. The input device 245 is configured to receive input from an attendee. For example, the user interface can include information prompting an attendee to input student ID information and provide biometric input through the biometric sensor 243. Subsequently, the attendee can input his student ID information through the input device 245, and provide his biometric input through the biometric sensor 243. In one example, the display device 244 is a liquid crystal display (LCD), the input device 245 is a touch panel, and the display device 244 and the input device 245 are integrated as a touch screen.

The host mobile device 200 may include other components or functions that are not shown in FIG. 2. For example, the host mobile device 200 may include other communication circuitry configured for communicating with various communication networks, such as a wireless or wired local area network (LAN), a cellular network, the Internet, and the like. The host mobile device 200 can also include a camera, a speaker, a GPS transceiver, and the like for performing various functions.

Figure 3:
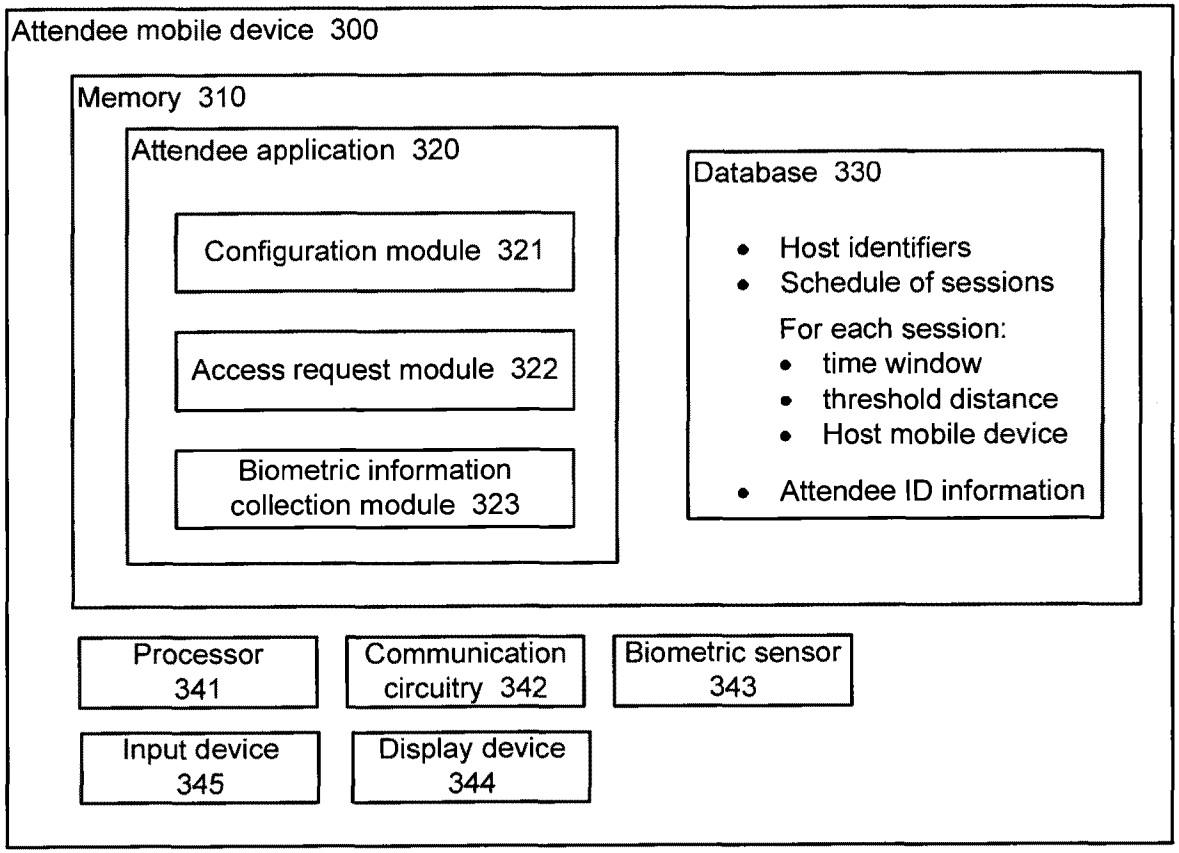
FIG. 3 shows an exemplary attendee mobile device according to an embodiment of the disclosure.

FIG. 3 shows an exemplary attendee mobile device 300 according to an embodiment of the disclosure. In one example, the attendee mobile device 300 is operated by a student, and configured to report attendance of students attending a class at a classroom in a school. Similar to the host mobile device 200, the attendee mobile device 300 can be any suitable mobile device, such as a laptop computer, a mobile phone, a tablet computer, a personal digital assistant (PDA), a smart watch, and the like. In addition, the attendee mobile device 300 includes hardware components, such as a memory 310, a processor 341, communication circuitry 342, a biometric sensor 343, a display device 344, an input device 345, and software components, such as various program instructions and data stored in the memory 310. The processor 341 operates according to the software components to perform various tasks.

The hardware components of the attendee mobile device 300 in FIG. 3, such as the memory 310, the processor 341, the communication circuitry 342, the biometric sensor 343, the display device 344, and the input device 345, have structures and functions similar to their counterparts of the host mobile device 200 in FIG. 2, such as the memory 210, the processor 241, the communication circuitry 242, the biometric sensor 243, the display device 244, and the input device 245. Thus, description of the hardware components of the attendee mobile device 300 is omitted for brevity.

In one example, the memory 310 stores an attendee application 320. The attendee application 320 includes instructions which, when executed by the processor 341, causes the processor 341 to perform various attendance reporting functions. In an example, the attendee application 320 can be downloaded from a website on the Internet, and installed on the host mobile device 300. In addition, in the one example, the memory 310 stores a database 330 containing data used or generated by the attendee application 320.

The database 330 can include one or more host identifiers each representing one or more host mobile devices 200, such as the host mobile devices 120 and 200 in FIG. 1 and FIG. 2, respectively. The host identifiers can be used to determine an available host mobile device 200 during an initialization process. For example, when an attendee operates the attendee application 320 to perform an attendance reporting process, the attendee application 321 can first retrieve a host identifier from the database 330, and subsequently consult the communication circuitry 342 to determine whether a host mobile device 200 to accept the attendance report is available. Specifically, in an example, the attendee application 321 can check, at the communication circuitry, a list of connected host mobile devices (represented by their respective identifiers) which are previously bonded to the attendee mobile device 300 and currently connected to the attendee mobile device 300. When the retrieved host identifier is included in the list of available host mobile devices, subsequent operations of an attendance reporting process, such as transmitting an initialization request, or an updating request, can be performed.

The database 330 can further include a schedule of classes (sessions). The classes can belong to one or more courses lectured by a same teacher or different teachers. Each class can be associated with a time window, a preconfigured threshold distance, and a host mobile device of a teacher (host) who lectures the respective session. In one example, information or updating information of schedules, time windows, and preconfigured threshold distances corresponding to sessions belonging to a course can be received from a host mobile device during an initialization process or an updating process performed by the access request module 322. The initialization process and the updating process are described below.

The database 330 can also include attendee ID information (e.g., student name or ID number) of a student who is the owner of the attendee mobile device 300. The attendee ID information can be used as default attendee ID information in some attendance reporting operations, thus simplifying the operations.

In one embodiment, the attendee application 320 includes modules executed by the processor 341 for performing attendance reporting functions, such as a configuration module 321, an access request module 322, and a biometric information collection module 323.

In an example, the configuration module 321 is configured to perform a configuration process. During the configuration process, an attendee associated with the attendee mobile device 300 (e.g., owner) can input to the database 330 one or more host identifiers representing host mobile devices associated with courses or sessions which the attendee has registered for. In addition, the attendee associated with the attendee mobile device 300 can input his student ID information in the database 330.

In an example, the access request module 322 is configured to perform an initialization process or an updating process to obtain session information of sessions a student has registered for when the student starts the attendee application 320 or starts an attendance reporting process. Specifically, the access request module 322 can first search a list of connected mobile devices at the communication circuitry 342 for connected host mobile devices using the one or more host identifiers stored in the database 330. When no host mobile device is available, unavailability information can be sent to the student via a user interface. When a host mobile device is connected, the access request module 322 searches the database 330 to determine whether information of sessions associated with the connected host mobile device has been stored in the database 330 (as described above, each session is associated with a host mobile device in the database 330). If not, the access request module 322 transmits an initialization request to the connected host mobile device to obtain session information of all sessions the student has registered for, and subsequently stores session information received from the connected host mobile device. Otherwise, the access request module 322 transmits an updating request to the connected host mobile device to obtain updated information of updated sessions. Subsequently, the access control module 322 updates session information stored in the database 330 based on received updating information. Discriminating updating operation from initialization operation can reduce communication traffic between an attendee mobile device and a host mobile device.

In an example, the access request module 322 is configured to examine whether some access conditions have been satisfied before transmitting an access request for reporting attendance. In one example, after the initialization or updating process, the access request module 322 first consults a schedule of sessions stored in the database 330 to determine if a time window associated with a session (a class) is currently available for reporting attendance (the first access condition). When no time window is available, the access control module 322 stops its operation, and information of unavailability of time window can be sent to the student via a user interface. When a time window is currently available, the access control module 322 can next examine the other access conditions.

In one example, the access control module 322 is configured to further examine whether a host mobile device associated with the session having an available time window is connected (the second access condition). For example, the access control module 322 retrieves from the data base 330 a host identifier associated with the session having a currently available time window, and checks a list of available (currently connected) host mobile devices maintained at the communication circuitry 342. When the host mobile device is not connected, the access control module 322 stops its operation, and information of unavailability of the host mobile device can be sent to the student via a user interface. When the host mobile device 200 is currently connected, the access control module 322 can next examine a third access condition.

In one example, the access control module 322 is configured to further examine whether an operation distance of the attendee mobile device 300 is shorter than a preconfigured threshold distance associated with the session having a time window available. For example, the access control module 322 retrieves from the data base 330 a preconfigured threshold distance associated with the session having the time window currently open. In addition, the access control module 322 receives from the communication circuitry 342 an estimated operation distance between the attendee mobile device 300 and the connected host mobile device. When the operation distance of the attendee mobile device 300 is longer than the preconfigured threshold distance, the access control module 322 stops its operation and send information to the student via a user interface.

The access request module 322 is further configured to transmit an access request for reporting attendance to a respective host mobile device when the above access conditions have been satisfied. The access request can include student ID information.

It is noted that determining whether some access conditions have been satisfied before transmitting an access request for reporting attendance can reduce communication traffic between an attendee mobile device and respective host mobile device. In addition, in various examples, which access conditions are examined and in what order can be configured using the configuration module 321. Further, operations of the initialization process, updating process, examining access conditions, and transmitting access control can be performed in background, meaning that an attendee need not to be involved. For example, after a user initiates an attendance reporting process by starting the attendee application 320 or clicks on a button at a user interface, the access request module 322 can operate automatically. When the above conditions are satisfied, the attendee will be prompted to provide a biometric input, thus simplifying the attendance reporting process for a user.

The biometric information collection (BIC) module 323 is configured to collect biometric information of an attendee and transmit, via the communication circuitry 342, the biometric information of the attendee to the respective host mobile device when the access request is authorized by the respective host mobile device. For example, the BIC module 323 can display a prompt information on the display device 344 requiring the attendee to provide a biometric input, and meanwhile triggers the biometric sensor 343 to take the biometric input and subsequently generate biometric information of the attendee. Thereafter, the BIC module 323 can transmit the biometric information to the respective host mobile device.

Figure 4:
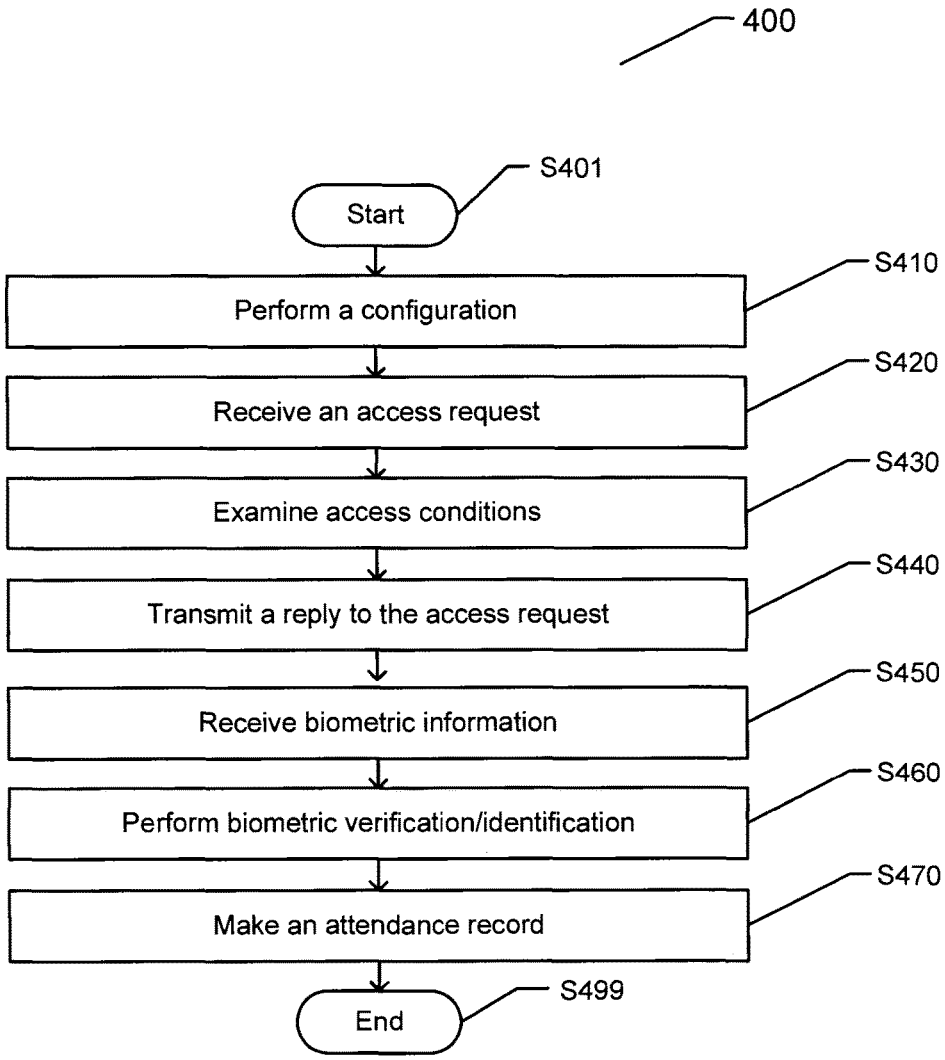
FIG. 4 shows a flow chart of a process for tracking attendance of a plurality of attendees at a host mobile device according to an embodiment of the disclosure.

FIG. 4 shows a flow chart of a process 400 for tracking attendance of a plurality of attendees at a host mobile device according to an embodiment of the disclosure. The plurality of attendees each operates an attendee mobile device to report their attendance to a class (session) in a classroom (area) to the host mobile device. The host mobile device 200 and the attendee mobile device 300 are used as example mobile devices to explain the process 400. The process 400 can be performed at the host mobile device 200. The process starts at S401, and proceeds to S410.

At S410, a configuration is performed to store biometric information of students, a schedule of sessions, and session information associated with each session to the database 230. The students have registered for classes lectured by a teacher operating the host mobile device 200. The session information can include a time window, an attendee list and a preconfigured threshold distance.

At S420, an access request including student ID information is received from the attendee mobile device 300.

At 5430, as a response to the access request, one or more access conditions are examined. The determination of which access conditions are examined can be set based on a previous attendance record of an attendee or other factors. For example, the access control module 222 can determine whether a time window is currently available, whether an operation distance of the attendee mobile device 300 is shorter than a preconfigured threshold distance associated with a session having the currently available time window, whether the student ID information is included in an attendee list associated with a session having the currently available time window.

At S440, a reply to the access request is transmitted to the attendee mobile device 300 to authorize the access request.

At S450, biometric information of an attendee is received from the attendee mobile device 300. The biometric information may be accompanied by student ID information when biometric verification is configured to be performed.

At S460, biometric verification or identification is performed to validate an attendance report. When performing biometric identification, biometric information of attendees in an attendee list which is associated with the session having a currently available time window can be retrieved from the database 230.

At S470, an attendance record can be made for an attendee who is identified, or verified and validated at S460. The process 400 proceeds to S499, and terminates at S499.

Figure 5:
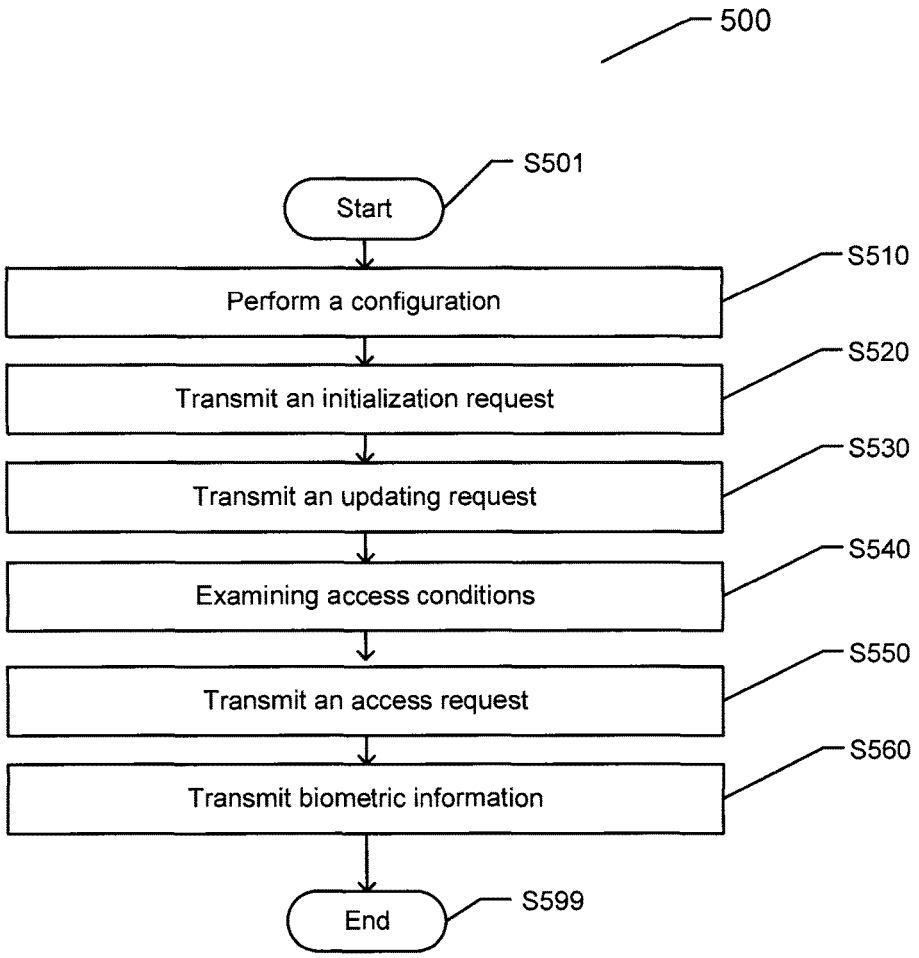
FIG. 5 shows a flow chart of a process for reporting attendance of a plurality of attendees from attendee mobile devices to a host mobile device according to an embodiment of the disclosure.

FIG. 5 shows a flow chart of a process 500 for reporting attendance of a plurality of attendees from attendee mobile devices to a host mobile device according to an embodiment of the disclosure. Each attendee can operate an attendee mobile device to report their attendance to a class (session) in a classroom (area) to the host mobile device. The host mobile device 200 and the attendee mobile device 300 are used as example mobile devices to explain the process 500. The process 500 can be performed at the attendee mobile device 300. The process starts at 5501, and proceeds to S510.

At S510, a configuration is performed by a student to store one or more host identifiers of one or more host mobile devices in the database 330. A host identifier represents a host mobile device having an owner (a teacher) whose classes a student (owner of the attendee device 300) has registered for. In addition, the configuration is performed to store attendee (student) ID information of the student in the database 330.

At 520, an initialization request including student ID information is transmitted to a host mobile device 200 to obtain session information of sessions the student has registered for when no previously stored session information is detected. The session information can include a time window, and a threshold distance. Subsequently, the session information can be stored in the database 330.

At 530, an updating request including student ID information is transmitted to a host mobile device 200 to obtain session updating information when previously stored session information is detected.

At 540, several access conditions are examined before transmitting an access request. For example, the access request module 322 can determine whether a time window associated with a session is currently available for reporting attendance, whether a host mobile device 200 associated the session having an available time window is connected to the attendee device 300 (available), whether an operation distance of the attended mobile device 300 is shorter than a threshold distance associated with the session having the available time window.

At 550, an access request is transmitted to the host mobile device 200 when the several access conditions are satisfied.

At 5560, biometric information of an attendee can be collected and transmitted to the host mobile device. Depending on the result of biometric verification or identification operation, the attendance reporting may be accepted or denied. The process 500 proceeds to S599 and terminates at S599.

While aspects of the present disclosure have been described in conjunction with the specific embodiments thereof that are proposed as examples, alternatives, modifications, and variations to the examples may be made. Accordingly, embodiments as set forth herein are intended to be illustrative and not limiting. There are changes that may be made without departing from the scope of the claims set forth below.

The invention claimed is:

1. A host mobile device for tracking attendance of a plurality of attendees operating an attendee mobile device, comprising:

processing circuitry configured to, receive an access request including attendee identification (ID) information of an attendee from an attendee mobile device, determine whether a set of access conditions are satisfied in response to the access request from the attendee mobile device, the set of access conditions including, whether current time is within an available time window that is currently open for attendees to report attendance, the available time window being associated with a session that attendees have registered for, whether an operation distance between the host mobile device and the attendee mobile device is shorter than a preconfigured threshold distance associated with the session having the available time window, the preconfigured threshold distance defining a border of an area for the session having the available time window, and whether the attendee identification (ID) information included in the access request is included in an attendee list associated with the session having the available time window, and allow the attendee mobile device to submit biometric information of an attendee to the host mobile device when the set of access conditions are satisfied.

2. The host mobile device of claim 1, wherein the processing circuitry is further configured to, receive biometric information from the attendee mobile device, perform biometric identification on the received biometric information to identify an attendee corresponding to the received biometric information, and make an attendance record of the identified attendee corresponding to the session having the available time window.

3. The host mobile device of claim 2, wherein the processing circuitry is further configured to, receive from the attendee mobile device biometric information of an attendee who is not an owner of the attendee mobile device.

4. The host mobile device of claim 2, wherein the processing circuitry is further configured to, perform biometric verification on the received biometric information to verify an attendee corresponding to the received biometric information.

5. The host mobile device of claim 1, further comprising:

a memory configured to store a schedule of a plurality of sessions each associated with, a time window for attendees to report attendance for the respective session, the time window including a starting time and an ending time, a preconfigured threshold distance defining a border of an area for the respective session, and an attendee list including attendees registered for the respective session.

6. The host mobile device of claim 1, further comprising communication circuitry configured to, establish a wireless communication channel between the host mobile device and the attendee mobile device, and estimate the operation distance between the host mobile device and the attendee mobile device based on strength of a wireless signal transmitted from the attendee mobile device.

7. The host mobile device of claim 6, wherein the communication circuitry implements Bluetooth low energy (BLE) technology.

8. An attendee mobile device for reporting attendance of an attendee to a host mobile device, comprising:

processing circuitry configured to, determine whether a set of access conditions are satisfied, the set of access conditions including, whether current time is within an available time window that is currently open for attendees to report attendance, the available time window being associated with a session that attendees have registered for, whether a host mobile device associated with the session having the available time window is currently connected to the attendee mobile device, and whether an operation distance between the currently connected host mobile device and the attendee mobile device is shorter than a preconfigured threshold distance defining a border of an area for the session having the available time window, and transmit an access request including attendee identification (ID) information of an attendee to the currently connected host mobile device when the set of access conditions are satisfied, and transmit biometric information of an attendee to the currently connected host mobile device when the access request is allowed by the currently connected host mobile device.

9. The attendee mobile device of claim 8, wherein the processing circuitry is further configured to, transmit an initialization request including attendee ID information to a host mobile device for session information of sessions that an attendee corresponding to the attendee ID information in the initialization request has registered for, the session information including a time window associated with the respective session and a threshold distance associated with the respective session.

10. The attendee mobile device of claim 8, wherein the processing circuitry is further configured to, transmit an updating request including attendee ID information to a host mobile device for session updating information of sessions that an attendee corresponding to the attendee ID information in the initialization request has registered for.

11. The attendee mobile device of claim 8, further comprising:

communication circuitry configured to, establish a wireless communication channel between the currently connected host mobile device and the attendee mobile device, and estimate an operation distance between the currently connected host mobile device and the attendee mobile device based on strength of a wireless signal transmitted from the currently connected host mobile device; and a biometric sensor configured to receive a biometric input from an attendee, and generate biometric information corresponding to the biometric input.

12. A method for tracking attendance of a plurality of attendees operating a plurality of attendee mobile devices near a host mobile device, comprising:

receiving an access request including attendee identification (ID) information of an attendee from an attendee mobile device;

determining, via processing circuitry, whether a set of access conditions are satisfied in response to the access request from the attendee mobile device, the set of access conditions including, whether current time is within an available time window that is currently open for attendees to report attendance, the available time window being associated with a session that attendees have registered for, whether an operation distance between the host mobile device and the attendee mobile device is shorter than a preconfigured threshold distance associated with the session having the available time window, the preconfigured threshold distance defining a border of an area for the session having the available time window, and whether the attendee identification (ID) information included in the access request is included in an attendee list associated with the session having the available time window; and allowing the attendee mobile device to submit biometric information of an attendee to the host mobile device when the set of access conditions are satisfied.

13. The method of claim 12, further comprising:

receiving biometric information from the attendee mobile device;

performing biometric identification on the received biometric information to identify an attendee corresponding to the received biometric information; and making an attendance record of the identified attendee corresponding to the session having the available time window.

14. The method of claim 13, further comprising:

receiving from the attendee mobile device biometric information of an attendee who is not an owner of the attendee mobile device.

15. The method of claim 13, further comprising:

performing biometric verification on the received biometric information to verify an attendee corresponding to the received biometric information.

16. The method of claim 12, further comprising:

storing a schedule of a plurality of sessions each associated with, a time window for attendees to report attendance for the respective session, the time window including a starting time and an ending time, a preconfigured threshold distance defining a border of an area for the respective session, and an attendee list including attendees registered for the respective session.

17. The method of claim 12, further comprising:

establishing, by communication circuitry, a wireless communication channel between the host mobile device and the attendee mobile device, and estimating, by the communication circuitry, the operation distance between the host mobile device and the attendee mobile device based on strength of a wireless signal transmitted from the attendee mobile device.

18. The method of claim 17, wherein the communication circuitry implements Bluetooth low energy (BLE) technology.

19. The method of claim 12, further comprising:

determining, at an attendee device, whether a second set of access conditions are satisfied, the second set of access conditions including, whether current time is within a time window that is currently open for attendees to report attendance, the time window being associated with a session that attendees have registered for, whether a host mobile device associated with the session having the time window is currently connected to the attendee mobile device, and whether an operation distance between the currently connected host mobile device and the attendee mobile device is shorter than a preconfigured threshold distance defining a border of an area for the session having the time window, and transmitting an access request including attendee ID information of an attendee to the currently connected host mobile device when the second set of access conditions are satisfied, and transmitting biometric information of an attendee to the currently connected host mobile device when the access request is allowed by the currently connected host mobile device.

20. The method of claim 19, further comprising:

transmitting an initialization request including attendee ID information from an attendee mobile device to a host mobile device for session information of sessions that an attendee corresponding to the attendee ID information in the initialization request has registered for, the session information including a time window associated with the respective session and a threshold distance associated with the respective session; and transmitting an updating request including attendee ID information from an attendee mobile device to a host mobile device for session updating information of sessions that an attendee corresponding to the attendee ID information in the initialization request has registered for.

* * * * *